United States Patent [19]

Lavrentiev et al.

[11] 4,145,601

[45] Mar. 20, 1979

[54] ELECTRIC HEATING INSTALLATION FOR HEATING HIGH PURITY LIQUID AND GASEOUS MEDIA

[76] Inventors: Konstantin A. Lavrentiev, ulitsa F. Engelsa, 42, kv. 43; Gennady P. Popov, Leninsky prospekt, 161, kv. 8; Ivan G. Popov, Leninsky prospekt, 148, kv. 27, all of Voronezh; Valentin I. Boroda, ulitsa Mira, 50, kv. 26; Vladimir N. Melnichuk, Borodinsky proezd, 14, kv. 49, both of Klin Moskovskoi Oblasti, all of U.S.S.R.

[21] Appl. No.: 733,371

[22] Filed: Oct. 18, 1976

[51] Int. Cl.[2] ..... F24H 1/12; H05B 3/00; H05B 3/16

[52] U.S. Cl. ..... 219/298; 137/341; 165/DIG. 8; 219/300; 219/301; 219/311; 219/338; 219/543; 222/146 HE; 338/55; 338/308

[58] Field of Search ..... 219/543, 547, 296–309, 219/311, 280, 281, 282, 338, 534, 535, 539, 553; 338/55, 308, 309; 222/146 R, 146 H, 146 HE; 137/341; 165/DIG. 8

[56] References Cited

U.S. PATENT DOCUMENTS

| | | | |
|---|---|---|---|
| 1,524,517 | 1/1925 | Jack | 219/298 X |
| 1,548,779 | 8/1925 | Falkenberg | 219/306 |
| 1,794,215 | 2/1931 | Titus | 219/301 UX |
| 1,994,934 | 3/1935 | Wagenseller | 165/132 X |
| 2,375,563 | 5/1945 | Kirk | 219/301 UX |
| 2,979,594 | 4/1961 | De Woody et al. | 219/547 X |
| 3,050,608 | 8/1962 | De Woody | 219/547 |
| 3,092,704 | 6/1963 | De Woody et al. | 219/301 UX |
| 3,105,136 | 9/1963 | Ashenfarb | 219/543 X |
| 3,126,469 | 3/1964 | Feldmann et al. | 219/301 X |
| 3,177,341 | 4/1965 | De Woody et al. | 219/543 X |

FOREIGN PATENT DOCUMENTS

| | | | |
|---|---|---|---|
| 857463 | 4/1940 | France | 219/298 |
| 983948 | 2/1965 | United Kingdom | 219/306 |

*Primary Examiner*—A. Bartis

*Attorney, Agent, or Firm*—Lackenbach, Lilling & Siegel

[57] ABSTRACT

The installation for heating liquid and gaseous media comprises at least one heating unit which consists of an insulating body whose external surface is coated with a conducting film. The heating unit is made as a combination of variable-section containers interconnected in series. Buses are used for delivering electric voltage to the conducting film.

The installation according to the invention increases the efficiency of heating extra-pure liquid and gaseous media three to four times, reduces the consumption of electric power three to four times and requires only a small amount of costly metals for its manufacture.

8 Claims, 3 Drawing Figures

ELECTRIC HEATING INSTALLATION FOR HEATING HIGH PURITY LIQUID AND GASEOUS MEDIA

FIELD OF THE INVENTION

The present invention relates to heating elements based on the principle of resistance heating and, more particularly, it relates to an installation for heating liquid and gaseous media without introducing any admixtures.

The semiconductor industry widely employs highly-purified deionized water for making semiconductor instruments. It is known that the semiconductor plates and crystals are washed most efficiently with hot extra-pure deionized water. This water improves the quality of washing, the dissolution of acidic residues and the appearance of the plates and crystals and raises the percentage of serviceable instruments. However, highly-purified deionized water features a high adsorptive capacity so that up to the present time heating it to 70°-80° C. without polluting it with admixtures was considered practically impossible.

The present invention is intended to solve this problem.

The invention can be employed in the radio industry, in medicine and in the food industry.

In medicine, for example, the present invention is used as a heater for the dialyzing liquid (salt solutions) employed in hemodialysis which is performed by the artificial kidney apparatus.

In the food industry the present invention can be used for pasteurization of milk, beer and juices.

DESCRIPTION OF THE PRIOR ART

Up to the present time, the deionized water used in semiconductor engineering was heated by coil-type heating installations. Such installations are cumbersome, require a large amount of special heat-resistant alloys, possess a low efficiency and output and cannot produce hot deionized water without introducing admixtures into it.

The known installation is essentially a carbon fluoride heat exchanger consisting of a bundle of capillary tubes with deionized water flowing inside. The heat exchanger is placed into a reservoir with a liquid of a high heat capacity. After being heated by metallic heaters, this liquid accumulates a large amount of heat and transmits it through the heat exchanger to the deionized water.

The known installation is difficult to manufacture, as it requires a large amount of costly heat-resistant alloys for its manufacture. Setting-up and tests of this installation are also very labor- and time-consuming.

Another known installation for heating liquid and gaseous media utilizes a heating element with a conducting film.

The known installation comprises a casing which accommodates a heating element consisting of a body made of insulating material whose external surface is coated with a conducting film connected by buses with electric power supply, inlet and outlet pipe unions of said body being connected with a system for supply and discharging the handled medium.

The heating element in this installation is made in the form of a double-walled cylinder with a vacuum between its walls.

Arranged inside the cylinder along the axis of the heating element is a metal pipe through which the medium being heated passes so that the conducting film is separated from the medium by a layer of air and by the wall of the metal pipe.

The heated medium flows inside the metal pipe and is heated only by the radiant energy produced by the conducting film.

The major part of the heat energy is spent for heating the casing and other parts of the installation. The efficiency of such a heating element is less than, or at most equal to, 4%. Besides, this installation is difficult to manufacture.

SUMMARY OF THE INVENTION

An object of the invention is to provide an installation for heating liquid and gaseous media with a heating element which is capable of heating extra-pure liquid and gaseous media without polluting them with any admixtures.

Another object of the invention is to heat extra-pure liquid and gaseous media with a high output and efficiency.

An object of the invention is to ensure the heating of extra-pure liquid and gaseous media with a high output and efficiency.

This object is achieved by providing an installation for heating liquid and gaseous media comprising a casing which accommodates at least one heating unit consisting of a body made of insulating film and inlet and outlet pipe unions of the body are connected to a system for supply and discharging the handled medium. According to the invention, the body of the heating unit is made in the form of a combination of interconnected variable-section containers. Buses are used for applying electric voltage to the conducting film.

It is preferable that in the installation for heating liquid and gaseous media the ratio between the maximum size of a variable-section container relative to its central axis and the maximum size of the neck should be from 1.5 to 3.

It is preferable that the casing of the installation, according to the invention, should accommodate a preset number of heating units combined into a group by headers which are connected with the inlet and outlet pipe unions of the insulating body of each heating element.

It is possible that the joint between each inlet and outlet pipe union of the heating element and the corresponding header be constituted by a bushing, made of a fluorinated plastic and press-fitted on the corresponding pipe union, and an elastic clamping coupling fitted around said joint.

The installation of the present invention increases upon heating the output of extra-pure liquid and gaseous media three to four times, reduces the consumption of electric power two to three times and requires only a small amount of costly metals for its manufacture.

BRIEF DESCRIPTION OF THE DRAWINGS

The invention will now be described in details with reference to specific embodiment illustrated in the accompanying drawings, in which.

DETAILED DESCRIPTION OF THE INVENTION

Figure 3:
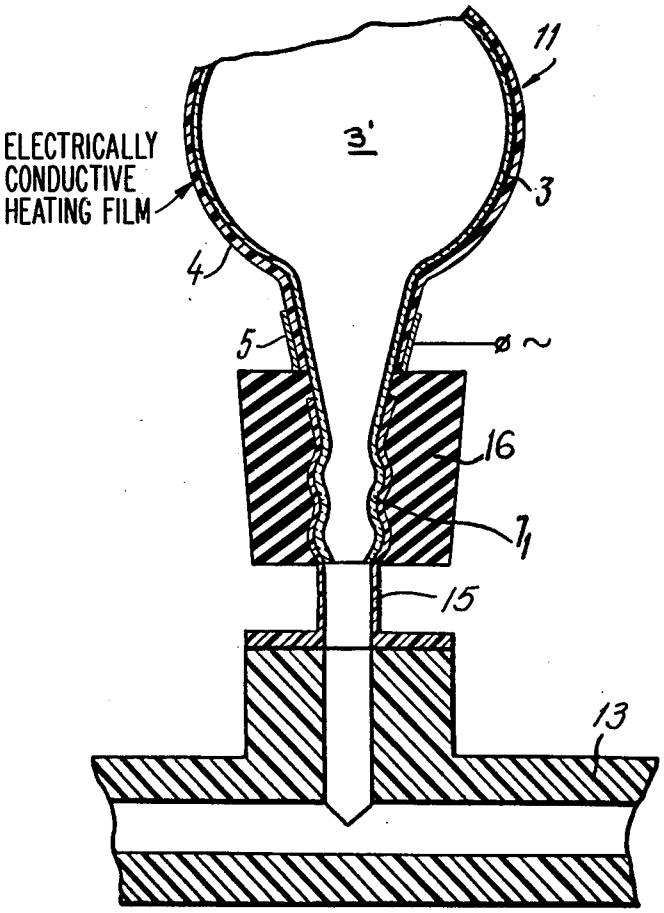
FIG. 3 is an enlarged, cross-sectional view showing the joint between one of the pipe unions of the heating unit and the header, according to the invention.

The installation for heating liquid and gaseous media comprises a casing 1 (FIG. 1) which accommodates at least one fluid heating unit 2 which consists of an insulating body 3 whose external surface is coated with a conducting film 4 connected by buses 5 with an electric supply system 6.

The body 3 of the fluid heating unit 2 in this embodiment of the installation is made of quartz and the conducting film 4 is applied to the external surface of the body 3 and is not in contact with the heated medium. This allows the extra-pure media to be heated in a closed volume without introducing any impurities therein, the medium being disposed in an interior chamber 3' of the insulating body 3 during the heating operation.

Inlet and outlet pipe unions 7 and 8 of the fluid heating unit 2 are connected with a system 9 for supplying and discharging the handled medium to and from the interior chamber 3' of the insulating body 3. Arrows 10 and 10' show the directions of admission of the medium into and its discharge out from the installation, respectively.

According to the invention, the fluid heating unit 2 is a combination of variable-section containers 11 made in the form of, for example, spherical vessels interconnected in series by necks with buses 5 (FIG. 1) are used for delivering electric voltage to the conducting film 4.

The ratio between the diameter of one container 11 and the maximum size or diameter of the neck varies from 1.5 to 3.

Figure 2:
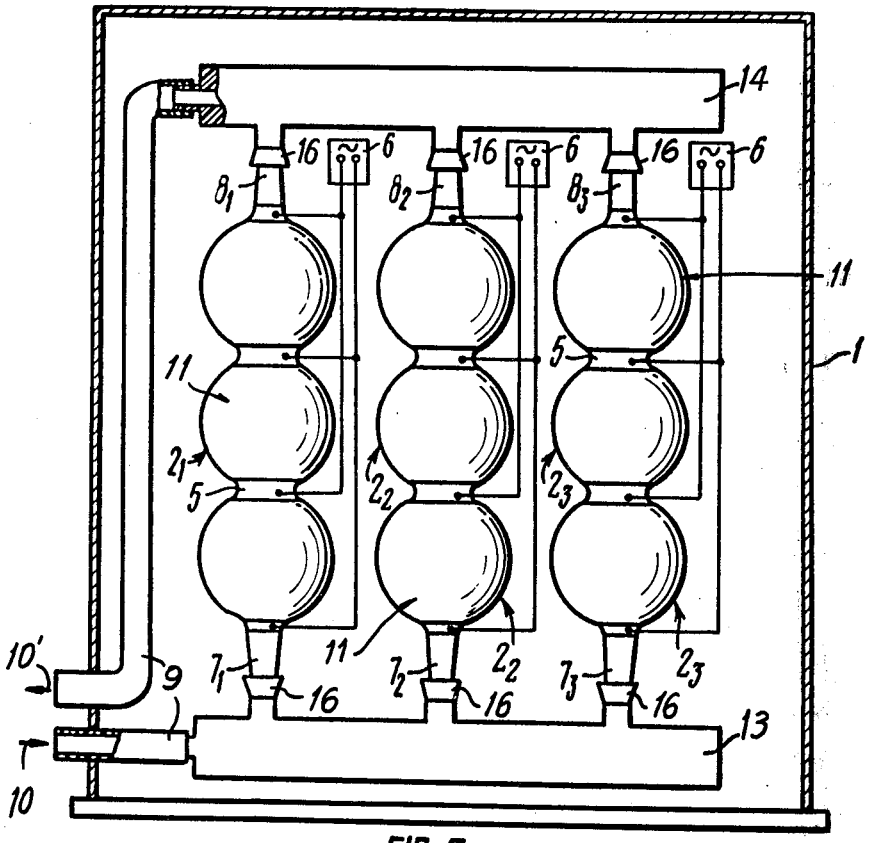
FIG. 2 is an elevational view showing the installation for heating liquid and gaseous media with three heating units combined in a group by means of headers, according to the invention.

Consider a version of the installation wherein the casing 1 accommodates a preset number of fluid heating units 2 (FIG. 2), for example three units $2_1$, $2_2$ and $2_3$, combined into a group by means of headers 13 and 14 connected with inlet pipe unions $7_1$, $7_2$ and $7_3$ and outlet pipe unions $8_1$, $8_2$ and $8_3$ of the heating units $2_1$, $2_2$ and $2_3$.

The joint between each inlet pipe union $7_1$, $7_2$ and $7_3$ of the fluid heating units $2_1$, $2_2$ and $2_3$ with the header 13 is made in the form of a bushing 15 (FIG. 3) which, for example, may be made of fluorinated plastic, which is press-fitted on the corresponding pipe union $7_1$, $7_2$ or $7_3$, and an elastic clamping coupling 16 which fits around this joint. The joint between the inlet pipe union $^7$ and the system $^9$ for supplying and discharging is similarly designed.

In view of the fact that flourinated plastic is a cold-flowing material the requisite tightness of the joint with the quartz pipe union, e.g. $7_1$, requires a constant clamping force uniformly distributed over the surface of the fluorinated-plastic shrunk bushing 15. This function is fulfilled without damaging the quartz pipe union $7_1$ by the elastic clamping coupling 16 made of, for example, rubber.

The joints between each outlet pipe union $8_1$, $8_2$ and $8_3$ of the fluid heating units $2_1$, $2_2$ and $2_3$ with the header 14 are made in a similar manner, as is the joint between the outlet pipe union 8 and the system 9 for supplying and discharging.

The liquid and gaseous media are heated in the installation according to the invention as follows.

Figure 1:
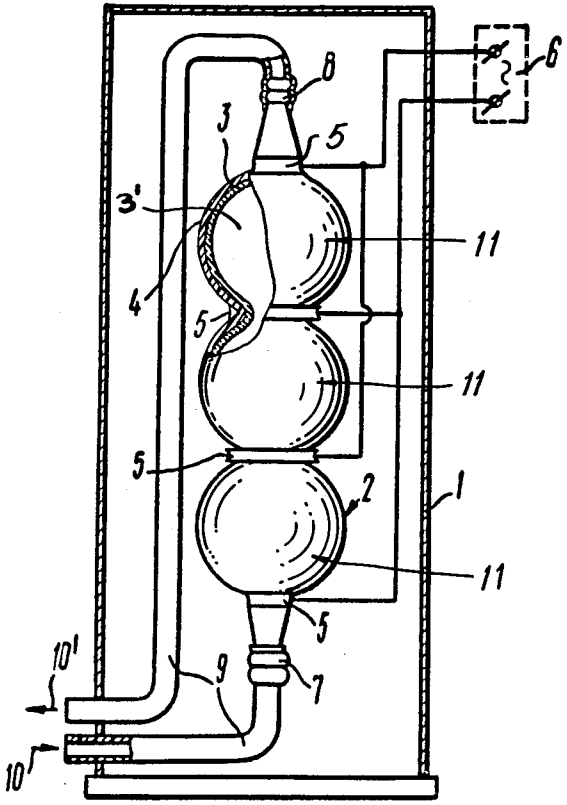
FIG. 1 is an elevational view showing the installation for heating liquid and gaseous media with one heating unit, according to the invention.

The medium enters the installation in the direction of arrow 10 and fills chamber 3' of the body 3 of the fluid heating unit 2 (FIG. 1).

The temperature of the medium entering the fluid heating unit is always lower than that of the ambient temperature. This provides for a temperature gradient whose vector points towards a higher temperature.

When electric voltage is delivered by the buses 5 to the conducting film 4, the film 4 becomes heated and radiates heat, the heat flow being directed opposite to the direction of the temperature gradient vector, i.e., into the body 3 of the heating unit 2.

The length of the radiated wave of the conducting film 4 is $\lambda = 4$ to 4.5 microns The heated medium heating to 100°--150° C. begins to radiate heat with a wave length $\lambda = 7$ to 8 microns.

The conducting film 4, preferably stannic oxide, has a reflecting capacity in the infrared part of the spectrum of electromagnetic vibrations. The maximum reflecting capacity of the conducting film 4 is developed at the wave lengths $\lambda = 8$ microns and 16 microns, therefore the conducting film 4 reflects 80°-90% of the energy radiated by a heated medium, e.g. water.

Besides, the mean speed of flow of the medium entering the fluid heating unit 2 changes in the circular necks from a laminar flow into a turbulent flow.

If the laminar flow of a medium, e.g. deionized water, is heated, the heat is transferred into the laminar flow at a slower rate since the coefficient of thermal conductivity of water is extremely low. In this case only a thin surface layer of the laminar flow of water gets heated while its inside portion receives heat only by radiation.

When the flow becomes turbulent, the thermal energy is transferred to the medium by radiation, heat conductivity and convection. This ensures prompt and efficient heating of the flowing medium. The total efficiency of the heating element, taking in account the reflecting properties of the film 4 and the presence of a turbulent flow, reaches 97%.

The use of spherical vessels in the variable-section containers 11 provides a large area heated by the conducting film 4 and a small size of the body 3 of the heating unit 2. The hollow sphere has a maximum strength limit in case of internal loads created by the medium flowing under pressure which makes it possible to make the hollow sphere with walls of a minimum thickness.

The ratios between the diameter of the variable-section container 11 and the maximum size or diameter of the neck, ranging from 1.5 to 3, depend on the degree of turbulence of the liquid flowing inside the heating element 2 and on the density of the electric current passing through the conducting film 4.

When the range of the ratios becomes greater than specified above, i.e., when the maximum diameter of the neck is decreased, the turbulence of the flow increases but the density of the current passing through the conducting film 4 increases and reaches a critical value at which the film 4 burns up.

When said range decreases, i.e., the maximum diameter of the neck is increased, the density of the current becomes lower which improves the working conditions of the film 4 but reduces the degree of turbulence of the flow which decrease the heat emission of the walls of the body.

When the installation utilizes a preset number of fluid heating units 2, its output increases by as many times as there are fluid heating units 2.

The installation according to the invention allows heating extra-pure media, e.g. deionized water, without introducing admixtures into them with a high efficiency, and does not require the use of a large amount of special heat-resistant alloys for making the heating units. For example, an installation with a capacity of 600 l/hr requires only a few tens of grams of such alloys. The installation is small in size, simple to manufacture and efficient.

We claim:

1. An installation for heating liquid and gaseous media comprising:

a casing;

at least one fluid heating unit accommodated inside of said casing, each fluid heating unit comprising an insulating body made of a plurality of variable-section containers connected in series by necks, said insulating body having an interior chamber through which a medium to be heated flows;

a heat radiating conducting film applied to an external surface of at least the containers of said body of each of said fluid heating units;

buses, for delivering electric voltage to said conducting film, connected to said conducting film;

inlet and outlet pipe unions connected to said interior chamber of said insulating body of each of said at least one heating unit; and a system for supplying and discharging said medium connected with the inlet and outlet pipe unions.

2. An installation according to claim 1 wherein the joint between each of said inlet and outlet pipe unions of each of said at least one fluid heating unit and the system for supplying and discharging includes a bushing, said bushing being made of fluorinated plastic press-fitted on the corresponding pipe union, and an elastic clamping coupling fitted around said joint.

3. An installation according to claim 1 wherein the insulating body of each of said at least one fluid heating unit comprises a plurality of hollow spherical containers connected in series by said necks.

4. An installation according to claim 3 wherein the ratio between the diameter of the hollow spherical containers and the maximum size of said necks ranges from 1.5 to 3.

5. An installation for heating liquid and gaseous media comprising:

a casing;

inlet and outlet headers located inside of said casing;

a plurality of fluid heating units accommodated in said casing, each of said fluid heating units being connected to said headers, each of said fluid heating units having an insulating body made as a plurality of variable-section containers connected in series by necks, said insulating body having an interior chamber through which a medium to be heated flows;

a heat radiating conducting film applied to an external surface of at least the containers of said body of each of said fluid heating units;

buses, for delivering electric voltage to said conducting film, connected to said conducting film on said insulating body of each of said fluid heating units;

inlet and outlet pipe unions connected to said interior chamber of said insulating body of each of said heating units and to said headers to provide a flow of said medium between said interior chamber and said headers; and a system for supplying and discharging said medium connected with said inlet and outlet headers.

6. An installation according to claim 5 wherein the joint between each of said inlet and outlet pipe unions of each of said fluid heating units and the header includes a bushing, said bushing being made of fluorinated plastic press-fitted on said corresponding pipe union, and an elastic clamping coupling which fits around said joint.

7. An installation according to claim 5, wherein each insulating body comprises a series of hollow spherical containers.

8. An installation according to claim 7 wherein the ratio between the diameter of the hollow spherical containers and the maximum size of said necks ranges from 1.5 to 3.

* * * * *